US010797443B2

(12) United States Patent
Cai

(10) Patent No.: US 10,797,443 B2
(45) Date of Patent: Oct. 6, 2020

(54) ELECTRICAL CONNECTOR

(71) Applicant: LOTES CO., LTD, Keelung (TW)

(72) Inventor: You Hua Cai, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/660,953

(22) Filed: Oct. 23, 2019

(65) Prior Publication Data

US 2020/0127419 A1 Apr. 23, 2020

(30) Foreign Application Priority Data

Oct. 23, 2018 (CN) ..... 2018 1 1233827

(51) Int. Cl.

*H01R 13/6471* (2011.01)
*H01R 12/70* (2011.01)
*H01R 12/71* (2011.01)
*H01R 13/6477* (2011.01)

(52) U.S. Cl.

CPC ..... *H01R 13/6471* (2013.01); *H01R 12/707* (2013.01); *H01R 12/712* (2013.01); *H01R 13/6477* (2013.01)

(58) Field of Classification Search

CPC ..... H01R 13/648; H01R 13/652; H01R 13/6585; H01R 13/6471; H01R 13/6477; H01R 24/22; H01R 24/30; H01R 12/707; H01R 12/712

USPC ..... 439/108

See application file for complete search history.

(56) References Cited

U.S. PATENT DOCUMENTS 5,224,867 A * 7/1993 Ohtsuki ..... H01R 13/6471 439/108
6,464,537 B1 * 10/2002 Letourneau ..... H01R 12/714 439/108
6,540,559 B1 * 4/2003 Kemmick ..... H01R 13/6585 439/607.05
6,666,696 B1 * 12/2003 Wu ..... H01R 12/725 439/108

(Continued)

FOREIGN PATENT DOCUMENTS

CN 102456990 B 1/2016
CN 107528138 A 12/2017

(Continued)

*Primary Examiner* — Gary F Paumen
(74) *Attorney, Agent, or Firm* — Locke Lord LLP; Tim Tingkang Xia, Esq.

(57) ABSTRACT

An electrical connector includes multiple signal terminals and multiple ground terminals paired to form multiple terminal groups and arranged in one row in a body. One signal terminal and one ground terminal form a first terminal group. Two signal terminals form a second terminal group. One ground terminal and one signal terminal form a third terminal group. An arrangement order of the two terminals in the third terminal group is different from an arrangement order of the two terminals in the first terminal group. Each terminal has a conducting portion. The conducting portions of the terminals in a same terminal group bend in a same direction, and the conducting portions of the terminals in adjacent terminal groups bend in opposite directions. The second terminal group is located between the first terminal group and the third terminal group, and between the adjacent ground terminals.

16 Claims, 5 Drawing Sheets

(56) References Cited

U.S. PATENT DOCUMENTS

| | | | | |
|---|---|---|---|---|
| 6,969,268 | B2 * | 11/2005 | Brunker | H04W 72/02 439/108 |
| 7,179,127 | B2 * | 2/2007 | Shiu | H01R 13/506 439/108 |
| 7,448,884 | B2 * | 11/2008 | Kato | H01R 13/658 439/108 |
| 7,708,569 | B2 * | 5/2010 | Sercu | H01R 12/724 439/108 |
| 8,167,631 | B2 * | 5/2012 | Ito | H01R 24/38 439/108 |
| 8,651,881 | B2 * | 2/2014 | Regnier | H01R 29/00 439/108 |
| 8,864,528 | B2 * | 10/2014 | Chung | H01R 13/6582 439/108 |
| 2002/0123254 | A1 * | 9/2002 | Kato | H01R 13/6585 439/108 |
| 2007/0149058 | A1 * | 6/2007 | Saito | H01R 13/6585 439/108 |
| 2010/0210124 | A1 * | 8/2010 | Li | H01R 12/724 439/108 |

FOREIGN PATENT DOCUMENTS

| | | |
|---|---|---|
| CN | 207705421 U | 8/2018 |
| TW | 422444 | 2/2001 |

* cited by examiner

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201811233827.1 filed in China on Oct. 23, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and in particular to an electrical connector that achieves high-frequency performance.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Currently, electrical connectors have been used in various fields. With the development of science and technology nowadays, the exchange rate of information is getting higher. Thus, the requirements for electrical connectors are getting higher. The electrical connectors are required to support high transmission rates, and the stability of signal transmission of electrical connectors needs to be improved. A conventional electrical connector is used for electrically connecting a mating component, and includes a body and multiple terminals arranged in two rows in the body. Each terminal has a base, a contact portion extending from one end of the base and electrically connected to the mating component, and a conducting portion bending and extending from the other end of the base to be exposed out of the body. The conducting portions of the terminals in the same row bend in the same direction, and the conducting portions of the terminals in different rows bend in opposite directions. The terminals include a plurality of signal terminals and a plurality of ground terminals, and two adjacent signal terminals in the same row are located between two adjacent ground terminals. Although the design increases a shielding effect of the ground terminals, crosstalk is easily generated between the ground terminals and the signal terminal pairs, which affects the high-frequency performance of the electrical connector, and results in no guarantee of the quality of signal transmission.

Therefore, a heretofore unaddressed need to design a new electrical connector exists in the art to address the aforementioned deficiencies and inadequacies.

SUMMARY

In view of the problems in the background, the present invention is directed to an electrical connector that ensures high-frequency performance and stable signal transmission.

In order to achieve the foregoing objective, the present invention adopts the following technical solutions:

An electrical connector is configured to mate with a mating component and an electrical component. The electrical connector includes: a body; and one row of terminals provided in the body, comprising a plurality of signal terminals and a plurality of ground terminals, wherein the terminals are paired to form a plurality of terminal groups, the terminal groups comprise at least one first terminal group, at least one second terminal group and at least one third terminal group, each of the at least one first terminal group is formed by one signal terminal of the plurality of signal terminals and one ground terminal of the plurality of ground terminals, each of the at least one second terminal group is formed by two signal terminals of the plurality of signal terminals, each of the at least one first terminal group is formed by one ground terminal of the plurality of ground terminals and one signal terminal of the plurality of signal terminals, and an arrangement order of the two terminals in each of the at least one third terminal group is different from an arrangement order of the two terminals in each of the at least one first terminal group, wherein each of the terminals has a base provided in the body, a contact portion extending from one end of the base configured to be electrically connected to the mating component, and a conducting portion bending and extending from another end of the base to be electrically connected to the electrical component; wherein the conducting portions of the terminals in a same terminal group bend in a same direction, and the conducting portions of the terminals in two adjacent ones of the terminal groups bend in opposite directions; and wherein the terminal groups comprise three adjacent terminal groups, the three adjacent terminal groups comprise a corresponding first terminal group, a corresponding second terminal group and a corresponding third terminal group, and in the three adjacent terminal groups, the corresponding second terminal group is located between the corresponding first terminal group and the corresponding third terminal group, and the ground terminal in the corresponding first terminal group and the ground terminal in the corresponding third terminal group are both adjacent to the corresponding second terminal group.

In certain embodiments, the terminal groups include a plurality of successive first terminal groups and a plurality of successive third terminal groups adjacent to each other.

In certain embodiments, the two signal terminals in the second terminal group form a differential signal pair.

In certain embodiments, one side of the second terminal group is adjacent to a plurality of first terminal groups successively arranged.

In certain embodiments, the other side of the second terminal group is adjacent to a plurality of third terminal groups successively arranged.

In certain embodiments, the conducting portion is soldered to the electrical component by surface-mount technology.

In certain embodiments, the electrical connector includes two rows of terminals provided in the body, each of the two rows of terminals comprising a plurality of signal terminals and a plurality of ground terminals, wherein the terminals in each of the two rows are paired to form a plurality of terminal groups, the terminal groups in each of the two rows comprise at least one first terminal group, at least one second terminal group and at least one third terminal group, each of the at least one first terminal group is formed by one signal terminal of the plurality of signal terminals and one ground terminal of the plurality of ground terminals, each of the at least one second terminal group is formed by two signal terminals of the plurality of signal terminals, each of the at least one third terminal group is formed by one ground terminal of the plurality of ground terminals and one signal terminal of the plurality of signal terminals, and an arrangement order of the two terminals in the third terminal group is different from an arrangement order of the two terminals in the first terminal group, wherein each of the terminals in each of the two rows has a base provided in the body, a contact portion extending from one end of the base configured to be electrically connected to the mating component, and a conducting portion bending and extending from another end of the base to be electrically connected to the electrical component; wherein the conducting portions of the terminals in a same terminal group in each of the two rows bend in a same direction, and the conducting portions of the terminals in two adjacent ones of the terminal groups in each of the two rows bend in opposite directions; the two rows of the terminals form a first row, a second row, a third row and a fourth row of the conducting portions in sequence, the first row and the fourth row of the conducting portions bend and extend away from each other, and the second row and the third row of the conducting portions bend and extend toward each other.

In certain embodiments, the conducting portion of at least one of the second terminal groups is located in the first row or the fourth row.

In certain embodiments, one of the second terminal groups in one of the two rows of the terminals is provided opposite to one of the first terminal groups or one of the third terminal groups in the other of the two rows of the terminals.

In certain embodiments, the conducting portions of the terminals in two terminal groups provided opposite to each other in the two rows of the terminals bend in a same direction.

In certain embodiments, the body includes a slot extending longitudinally to be inserted by the mating component, the contact portion is exposed in the slot to contact the mating component, and the two rows of terminals are provided at two opposite sides of the slot.

In certain embodiments, each of the two rows of the terminals further comprises a plurality of power terminals and a plurality of reserved terminals, the reserved terminals are configured to be used as power, signal or ground terminals, and the two rows of the terminals collectively occupy 288 terminal positions, wherein in one of the two rows of terminals, a first position, a second position and a third position are occupied by the power terminals, a fourth position, a fifth position, a seventh position, a ninth position, an eleventh position, a twelfth position, a fourteenth position, a sixteenth position, an eighteenth position, a 20th position, a 22nd position, a 23rd position, a 25th position, a 27th position, a 29th position, a 31st position, a 33rd position, a 34th position, a 36th position, a 38th position, a 40th position, a 42nd position, a 44th position, a 45th position, a 47th position, a 49th position, a 51st position, a 53rd position, a 55th position, a 56th position, a 58th position, a 60th position, a 62nd position, a 64th position, a 66th position, a 68th position, a 70th position, a 72nd position, a 74th position, a 76th position, a 78th position, an 80th position, an 82nd position, an 84th position, an 86th position, an 87th position, an 89th position, a 91st position, a 93rd position, a 94th position, a 96th position, a 98th position, an 100th position, an 102nd position, an 104th position, an 105th position, an 107th position, an 109th position, an 111th position, an 113th position, an 115th position, an 116th position, an 118th position, an 120th position, an 122nd position, an 124th position, an 126th position, an 127th position, an 129th position, an 131st position, an 133rd position, an 135th position, an 137th position, an 138th position, an 140th position and an 142nd position are occupied by the signal terminals, a sixth position, an eighth position, a tenth position, a thirteenth position, a fifteenth position, a seventeenth position, a nineteenth position, a 21st position, a 24th position, a 26th position, a 28th position, a 30th position, a 32nd position, a 35th position, a 37th position, a 39th position, a 41st position, a 43rd position, a 46th position, a 48th position, a 50th position, a 52nd position, a 54th position, a 57th position, a 59th position, a 61st position, a 63rd position, a 65th position, a 67th position, a 69th position, a 71st position, a 73rd position, a 75th position, a 77th position, a 79th position, an 81st position, an 83rd position, an 85th position, an 88th position, a 90th position, a 92nd position, a 95th position, a 97th position, a 99th position, an 101st position, an 103rd position, an 106th position, an 108th position, an 110th position, an 112th position, an 114th position, an 117th position, an 119th position, an 121st position, an 123rd position, an 125th position, an 128th position, an 130th position, an 132nd position, an 134th position, an 136th position, an 139th position, an 141st position and an 143rd position are occupied by the ground terminals, and a 144th position is occupied by one of the reserved terminals; and wherein in the other of the two rows of terminals, an 145th position and an 146th position are occupied by the power terminals, an 147th position, an 148th position, an 149th position, an 150th position, a 220th position, a 231st position and a 232nd position are the reserved terminals, an 151st position, an 153rd position, an 155th position, an 158th position, an 160th position, an 162nd position, an 164th position, an 166th position, an 169th position, an 171st position, an 173rd position, an 175th position, an 177th position, an 180th position, an 182nd position, an 184th position, an 186th position, an 188th position, an 191st position, an 193rd position, an 195th position, an 197th position, an 199th position, a 202nd position, a 204th position, a 206th position, a 208th position, a 210th position, a 212th position, a 214th position, a 216th position, a 219th position, a 222nd position, a 224th position, a 226th position, a 228th position, a 230th position, a 233rd position, a 235th position, a 237th position, a 240th position, a 242nd position, a 244th position, a 246th position, a 248th position, a 251st position, a 253rd position, a 255th position, a 257th position, a 259th position, a 262nd position, a 264th position, a 266th position, a 268th position, a 270th position, a 273rd position, a 275th position, a 277th position, a 279th position, a 281st position, 284th position, a 286th position and a 288th position are occupied by the ground terminals, and an 152nd position, an 154th position, an 156th position, an 157th position, an 159th position, an 161st position, an 163rd position, an 165th position, an 167th position, an 168th position, an 170th position, an 172nd position, an 174th position, an 176th position, an 178th position, an 179th position, an 181st position, an 183rd position, an 185th position, an 187th position, an 189th position, an 190th position, an 192nd position, an 194th position, an 196th position, an 198th position, a 200th position, a 201st position, a 203rd position, 205th position, a 207th position, a 209th position, a 211th position, a 213th position, a 215th position, a 217th position, a 218th position, a 221st position, a 223rd position, a 225th position, a 227th position, a 229th position, 234th position, a 236th position, a 238th position, a 239th position, a 241st position, a 243rd position, a 245th position, a 247th position, a 249th position, a 250th position, a 252nd position, a 254th position, a 256th position, 258th position, a 260th position, a 261st position, a 263rd position, a 265th position, a 267th position, a 269th position, a 271st position, a 272nd position, a 274th position, a 276th position, a 278th position, a 280th position, 282nd position, a 283rd position, a 285th position and a 287th position are occupied by the signal terminals.

In certain embodiments, the conducting portions of the terminals in each of the two rows respectively correspond to the conducting portions of the terminals in the first terminal groups, the conducting portions of the terminals in the second terminal groups and the conducting portions of the terminals in the third terminal groups.

In certain embodiments, the four rows of the conducting portions are all soldered to the electrical component by surface-mount technology.

In certain embodiments, the body includes a slot extending longitudinally for inserting the mating component, the body is provided with a key buckle in the slot to engage with a notch on the mating component, the key buckle divides the slot into two portions having different lengths, and the key buckle is located between the two terminals of one of the terminal groups.

In certain embodiments, the key buckle is located between the two terminals of one of the first terminal groups or between the two terminals of one of the third terminal groups.

Compared with the related art, the electrical connector according to certain embodiments of the present invention have the following beneficial effects.

In the present invention, the second terminal group is located between the first terminal group and the third terminal group, the ground terminal of the first terminal group and the ground terminal of the third terminal group are adjacent to the two signal terminals of the second terminal group, and the bending direction of the conducting portions of the terminals in the second terminal group is opposite to the bending direction of the conducting portions of the terminals in the first terminal group and the third terminal group, such that the two signal terminals are staggered from the two ground terminals located at two sides thereof, thereby increasing the distance between the signal terminals and the ground terminals, reducing the interference of the ground terminals to the signal terminals, reducing the signal crosstalk, and ensuring the high-frequency performance of the connector.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
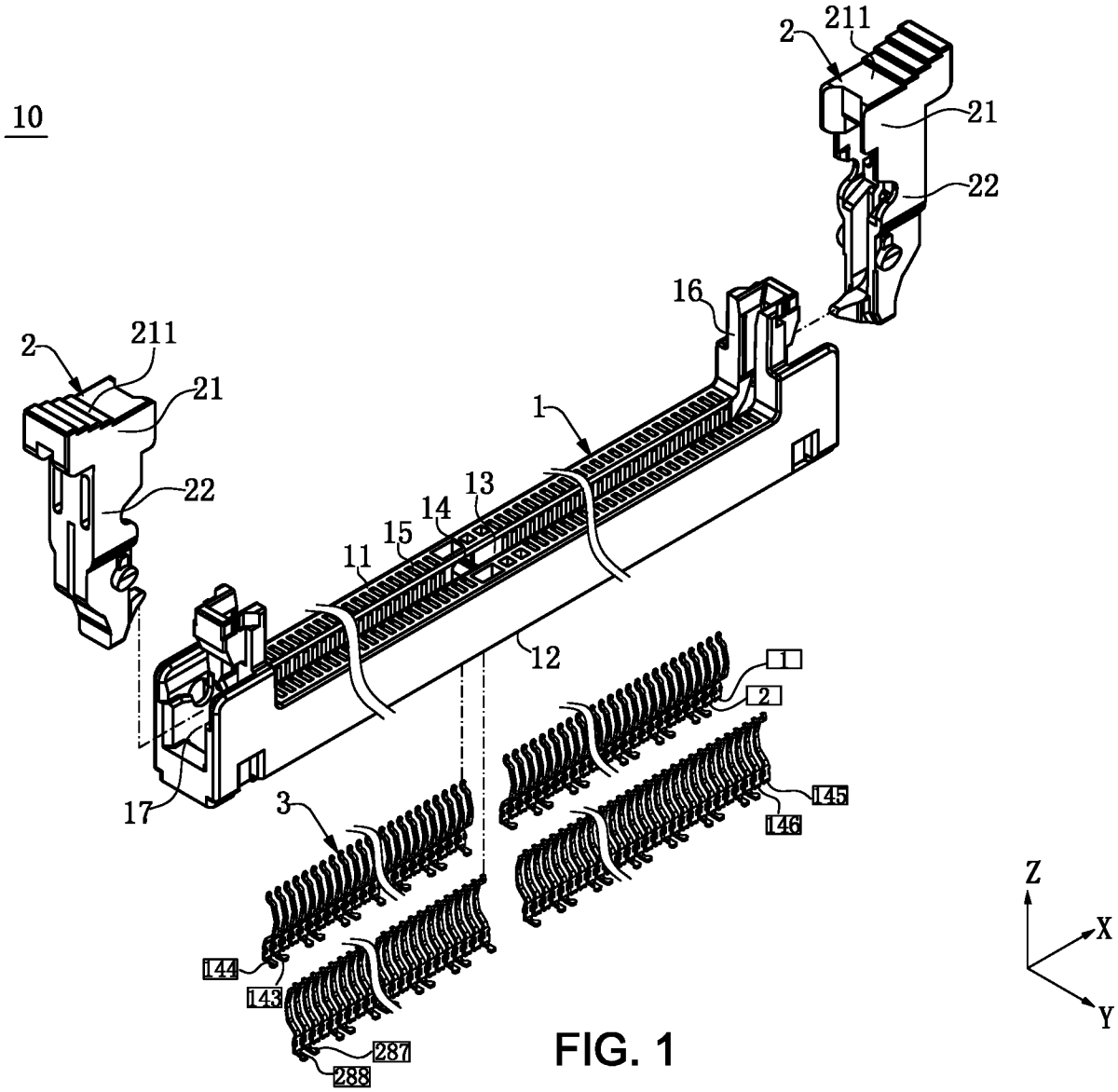
FIG. 1 is a perspective exploded view of an electrical connector according to certain embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated. As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-5. In accordance with the purposes of this invention, as embodied and broadly described herein, this invention, in one aspect, relates to an electrical connector.

For convenience of description, an x-axis direction is defined as a front-rear direction, a y-axis direction is defined as a left-right direction, and a z-axis direction is defined as a vertical direction.

FIG. 1 shows an electrical connector 10 for connecting a mating component (not labeled) and an electrical component (not labeled). In this embodiment, the mating component is an electronic card and is mounted into the electrical connector 10 downward from top thereof, and the electrical component is a circuit board. The electrical connector 10 includes a body 1, two ear clips 2 retained by the body 1, and a plurality of terminals 3 arranged in a left row and a right row in the body 1 in the X-axis direction.

Figure 2:
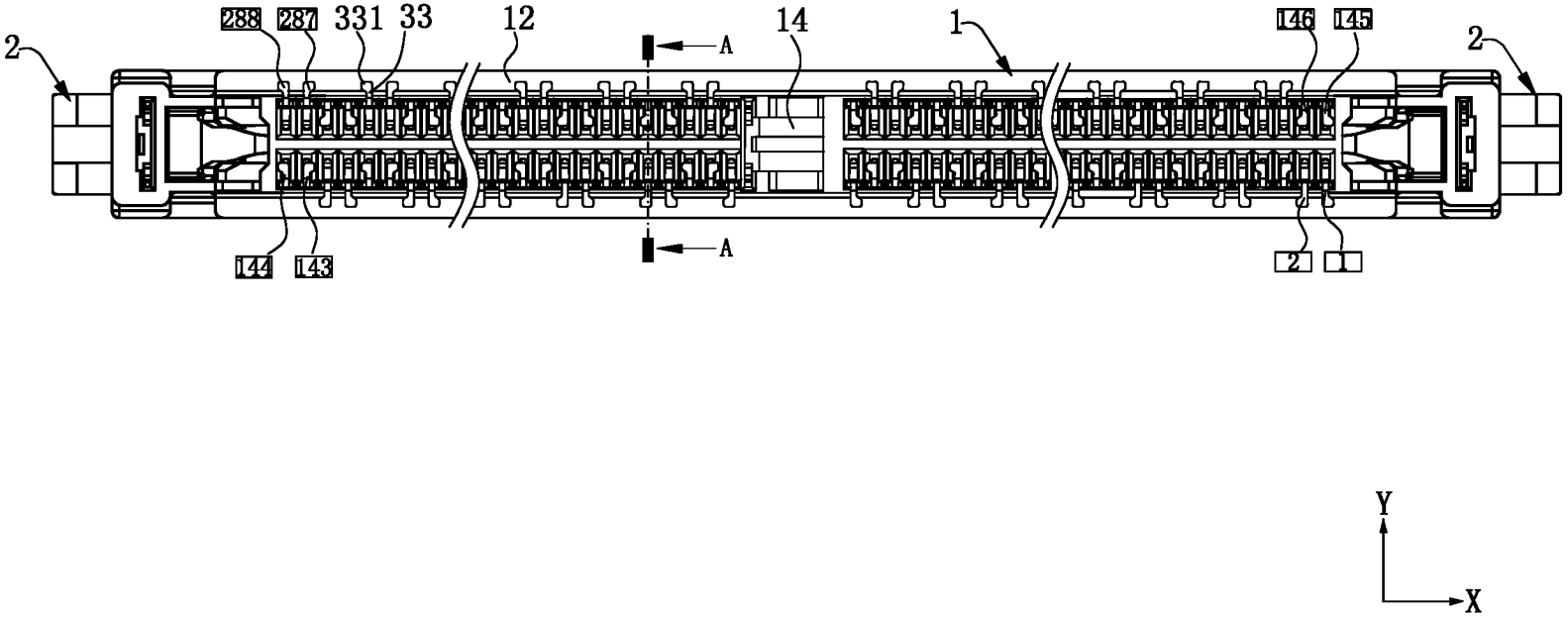
FIG. 2 is a bottom view of FIG. 1.

Referring to FIG. 1 and FIG. 2, the body 1 includes a top end 11 and a bottom end 12 provided opposite to each other, and an elongated slot 13 recessed downward from the top end 11 to accommodate the mating component. The body 1 is provided with a key buckle 14 in the slot 13 to engage with a notch on the mating component so as to prevent the mating component from ill-insertion and causing damage to the electrical connector 10. The key buckle 14 divides the slot 13 into two asymmetrical portions. Multiple accommodating holes 15 are arranged in a left row and a right row in the body 1. The accommodating holes 15 run downward through the body 1 from the top end 11 and are located at the two sides of the slot 13 and communicate with the slot 13. A distance between the accommodating holes 15 in a same row is constant, and the accommodating holes 15 in the left and right rows are symmetrical to each other. The body 1 further includes two mounting portions 16 located at a front side and a rear side of the body 1. The mounting portions 16 are formed by extending upward from the top end 11. A mounting slot 17 is recessed from an upper end of each mounting portion 16, and the mounting slot 17 runs through the body 1 vertically.

As shown in FIG. 1, the two ear clips 2 are respectively correspondingly provided on the two mounting portions 16. An upper end of each ear clip 2 has a pressing portion 21, and a surface of the pressing portion 21 is provided with a pressing surface 211 which is step-shaped. The pressing surface 211 increases the friction force when being pressed by a user, which is convenient to use. An insertion portion 22 vertically extends downward from the pressing portion 21 and is mounted to the mounting slot 17. Each ear clip 2 is fixed to the corresponding mounting portion 16 and is rotatable relative to the mounting portion 16. When the pressing surface 211 is pressed, the corresponding ear clip 2 rotates to abut and eject the mating component, thereby facilitating the removal of the mating component.

Figure 3:
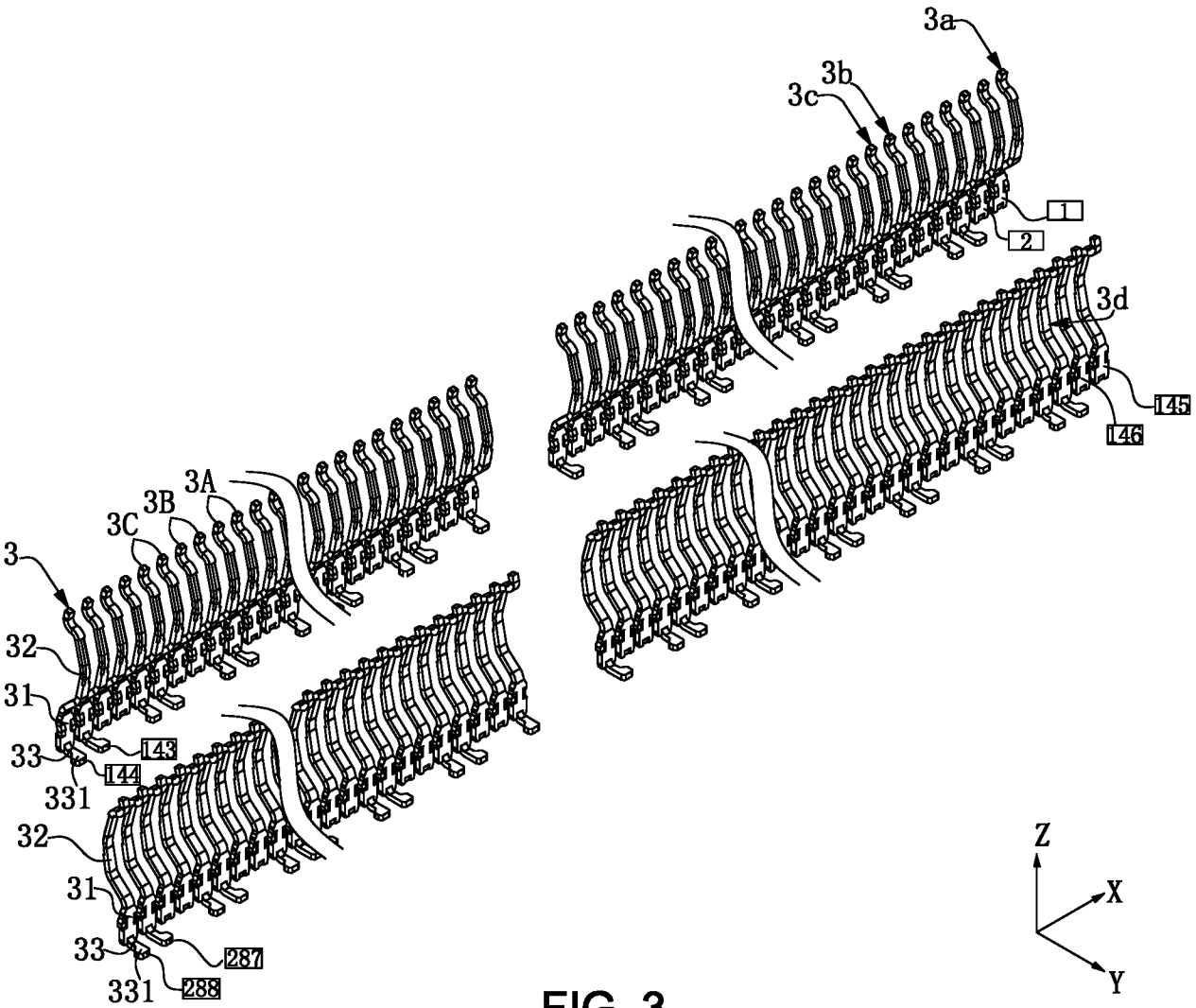
FIG. 3 is a perspective view of a terminal in FIG. 1.

As shown in FIG. 1, FIG. 2 and FIG. 3, the terminals 3 is arranged in two rows and correspondingly accommodated in the accommodating holes 15. Each terminal 3 includes a base 31 fixed in the body 1, and a contact portion 32 bending and extending upward from the base 31 toward the slot 13. A portion of the contact portion 32 protrudes into the slot 13 to be electrically connected to the mating component. The base 31 extends downward to be exposed out of the body 1 and then bends to form a conducting portion 33 to be electrically connected to the electrical component. In this embodiment, the conducting portion 33 is soldered to the electrical component by surface mount technology. A widened portion 331 protrudes from a free end of the conducting portion 33 toward one side, and the widened portion 331 is wider than other portions of the conducting portion 33. The widened portion 331 increases the electrical contact area between the conducting portion 33 and the circuit board, and ensures the stable contact between each terminal 3 and the circuit board.

Figure 4:
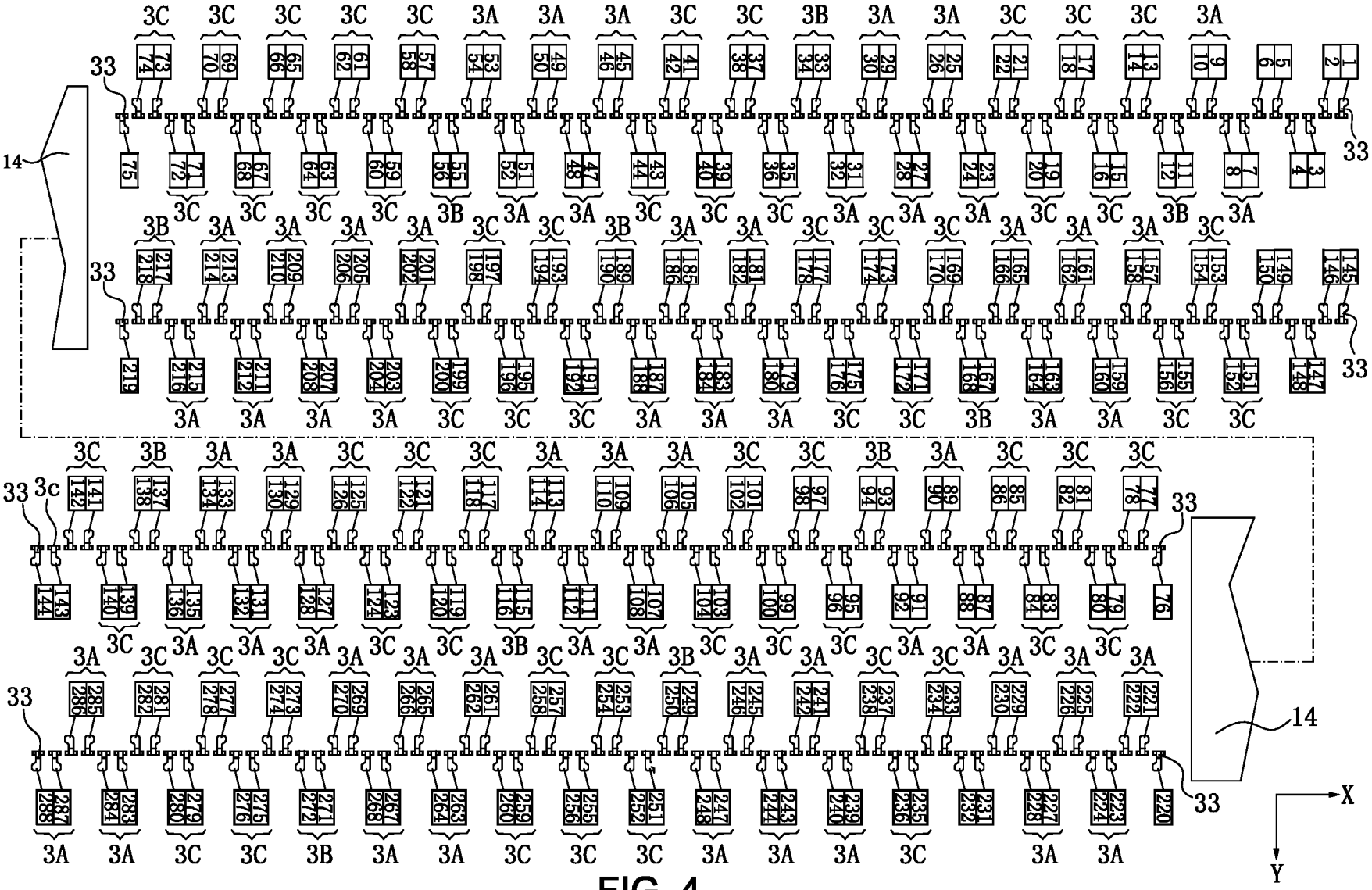
FIG. 4 is a plain schematic view of distribution of conducting portions of the terminals in FIG. 3.

As shown in FIG. 3 and FIG. 4, the two rows of the terminals 3 occupy a total of 288 terminal positions, and the conducting portions 33 of the two rows of the terminals 3 are arranged in a first row, a second row, a third row and a fourth row from left to right. The conducting portions 33 in the first row and third row bend leftward, and the conducting portions 33 in the second row and fourth row bend rightward. The conducting portions 33 in the first row and second row correspond to the terminals 3 occupying the first to 144th terminal positions, and the conducting portion 33 at the frontmost end of the first row is located in front of the conducting portion 33 at the frontmost end of the second row. The conducting portions 33 in the third row and fourth row correspond to the terminals 3 occupying the 145th to 288th terminal positions, and the conducting portion 33 at the frontmost end of the third row is located in front of the conducting portion 33 at the frontmost end of the fourth row.

As shown in FIG. 3 and FIG. 4, the two rows of the terminals 3 include multiple power terminals 3*a*, multiple signal terminals 3*b*, multiple ground terminals 3*c* and multiple reserved terminals 3*d*, and the two rows of the terminals 3 occupy 288 terminal positions (as first to 288th positions). In the present preferred embodiment, a first position (labeled as 1 in the drawing, and other terminal positions are also shown in the drawing in similar forms, which will not be elaborated below), a second position, a third position, an 145th position and an 146th position are occupied by the power terminals 3*a*; a fourth position, a fifth position, a seventh position, a ninth position, an eleventh position, a twelfth position, a fourteenth position, a sixteenth position, an eighteenth position, a 20th position, a 22nd position, a 23rd position, a 25th position, a 27th position, a 29th position, a 31st position, a 33rd position, a 34th position, a 36th position, a 38th position, a 40th position, a 42nd position, a 44th position, a 45th position, a 47th position, a 49th position, a 51st position, a 53rd position, a 55th position, a 56th position, a 58th position, a 60th position, a 62nd position, a 64th position, a 66th position, a 68th position, a 70th position, a 72nd position, a 74th position, a 76th position, a 78th position, an 80th position, an 82nd position, an 84th position, an 86th position, an 87th position, an 89th position, a 91st position, a 93rd position, a 94th position, a 96th position, a 98th position, an 100th position, an 102nd position, an 104th position, an 105th position, an 107th position, an 109th position, an 111th position, an 113th position, an 115th position, an 116th position, an 118th position, an 120th position, an 122nd position, an 124th position, an 126th position, an 127th position, an 129th position, an 131st position, an 133rd position, an 135th position, an 137th position, an 138th position, an 140th position, an 142nd position, an 152nd position, an 154th position, an 156th position, an 157th position, an 159th position, an 161st position, an 163rd position, an 165th position, an 167th position, an 168th position, an 170th position, an 172nd position, an 174th position, an 176th position, an 178th position, an 179th position, an 181st position, an 183rd position, an 185th position, an 187th position, an 189th position, an 190th position, an 192nd position, an 194th position, an 196th position, an 198th position, a 200th position, a 201st position, a 203rd position, 205th position, a 207th position, a 209th position, a 211th position, a 213th position, a 215th position, a 217th position, a 218th position, a 221st position, a 223rd position, a 225th position, a 227th position, a 229th position, 234th position, a 236th position, a 238th position, a 239th position, a 241st position, a 243rd position, a 245th position, a 247th position, a 249th position, a 250th position, a 252nd position, a 254th position, a 256th position, 258th position, a 260th position, a 261st position, a 263rd position, a 265th position, a 267th position, a 269th position, a 271st position, a 272nd position, a 274th position, a 276th position, a 278th position, a 280th position, 282nd position, a 283rd position, a 285th position and a 287th position are occupied by the signal terminals 3*b*; a sixth position, an eighth position, a tenth position, a thirteenth position, a fifteenth position, a seventeenth position, a nineteenth position, a 21st position, a 24th position, a 26th position, a 28th position, a 30th position, a 32nd position, a 35th position, a 37th position, a 39th position, a 41st position, a 43rd position, a 46th position, a 48th position, a 50th position, a 52nd position, a 54th position, a 57th position, a 59th position, a 61st position, a 63rd position, a 65th position, a 67th position, a 69th position, a 71st position, a 73rd position, a 75th position, a 77th position, a 79th position, an 81st position, an 83rd position, an 85th position, an 88th position, a 90th position, a 92nd position, a 95th position, a 97th position, a 99th position, an 101st position, an 103rd position, an 106th position, an 108th position, an 110th position, an 112th position, an 114th position, an 117th position, an 119th position, an 121st position, an 123rd position, an 125th position, an 128th position, an 130th position, an 132nd position, an 134th position, an 136th position, an 139th position, an 141st position and an 143rd position, an 151st position, an 153rd position, an 155th position, an 158th position, an 160th position, an 162nd position, an 164th position, an 166th position, an 169th position, an 171st position, an 173rd position, an 175th position, an 177th position, an 180th position, an 182nd position, an 184th position, an 186th position, an 188th position, an 191st position, an 193rd position, an 195th position, an 197th position, an 199th position, a 202nd position, a 204th position, a 206th position, a 208th position, a 210th position, a 212th position, a 214th position, a 216th position, a 219th position, a 222nd position, a 224th position, a 226th position, a 228th position, a 230th position, a 233rd position, a 235th position, a 237th position, a 240th position, a 242nd position, a 244th position, a 246th position, a 248th position, a 251st position, a 253rd position, a 255th position, a 257th position, a 259th position, a 262nd position, a 264th position, a 266th position, a 268th position, a 270th position, a 273rd position, a 275th position, a 277th position, a 279th position, a 281st position, 284th position, a 286th position and a 288th position are occupied by the ground terminals 3*c*; and an 144th position, an 147th position, an 148th position, an 149th position, an 150th position, a 220th position, a 231st position and a 232nd position are occupied by the reserved terminals 3*d*. The key buckle 14 is located between the terminal 3 in the 75th position and the terminal 3 in the 76th position, and also located between the terminal 3 in the 219th position and the terminal 3 in the 220th position.

Figure 5:
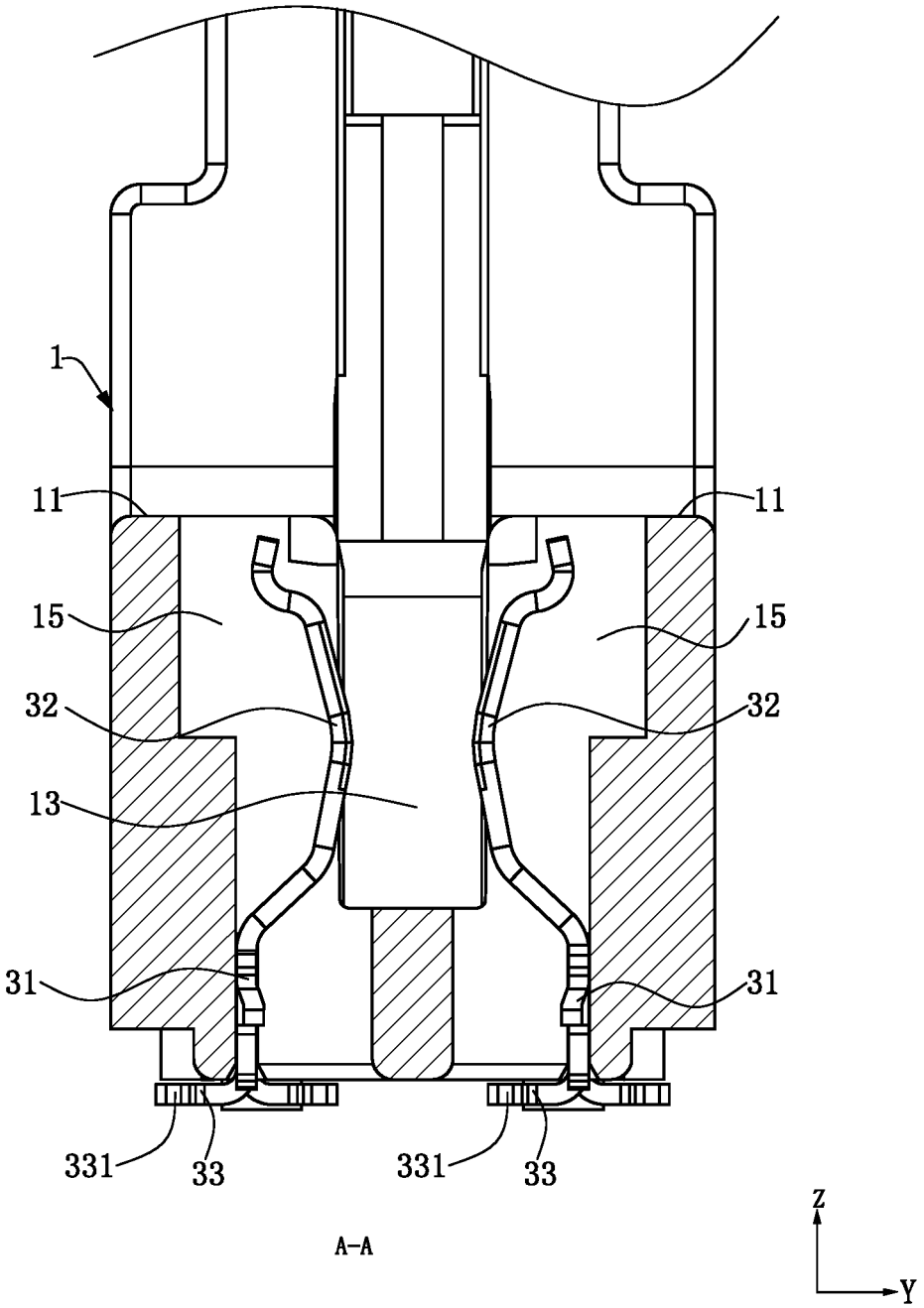
FIG. 5 is a sectional view of FIG. 2 along line A-A.

As shown in FIG. 3 and FIG. 5, the two rows of terminals 3 are paired to form a plurality of terminal groups (not labeled). The conducting portions 33 of the two terminals 3 in each terminal group bend in the same direction, and the conducting portions 33 of two adjacent terminal groups in the same row bend in opposite directions. The conducting portions 33 in one of the terminal groups bend leftward, and the conducting portions 33 of the other adjacent terminal group bend rightward. The conducting portions 33 in the two opposite terminal groups in different rows bend in the same direction, and the conducting portions 33 of the terminals 3 in the two rows are arranged in four rows on the electrical component. In the same terminal group, the conducting portion 33 of the terminal 3 at the front protrudes forward to form the widened portion 331, and the conducting portion 33 of the terminal 3 arranged at the rear protrudes backward to form the widened portion 331, such that the two adjacent widened portions 331 do not contact each other, thereby avoiding from short-circuiting caused by the contact between the two adjacent terminals 3.

As shown in FIG. 3 and FIG. 4, one of the signal terminals 3*b* and an adjacent ground terminal 3*c* form a first terminal group 3A, and the signal terminal 3*b* is located in front of the ground terminal 3*c*. Two adjacent signal terminals 3*b* form a second terminal group 3B, and two signal terminals 3*b* either form a differential signal pair or are two independent signal terminals 3*b*. One of the ground terminals 3*c* and an adjacent signal terminal 3*b* form a third terminal group 3C, and the ground terminal 3*c* is located in front of the signal terminal 3*b*. As shown in the arrangement of the two rows of terminals 3 in this embodiment, the five successive first terminal groups 3A (for example, the signal terminal 3*b* in the 23rd position and the ground terminal 3*c* in the 24th position, the signal terminal 3*b* in the 25th position and the ground terminal 3*c* in the 26th position, the signal terminal 3*b* in the 27th position and the ground terminal 3*c* in the 28th position, the signal terminal 3*b* in the 29th position and the ground terminal 3*c* in the 30th position, the signal terminal 3*b* in the 31st position and the ground terminal 3*c* in the 32nd position) are adjacent to the five successive third terminal groups 3C (for example, the ground terminal 3*c* in the thirteenth position and the signal terminals 3*b* in the fourteenth position, the ground terminal 3*c* in the fifteenth position and the signal terminals 3*b* in the sixteenth position, the ground terminal 3*c* in the seventeenth position and the signal terminals 3*b* in the eighteenth position, the ground terminal 3*c* in the nineteenth position and the signal terminals 3*b* in the 20th position, and the ground terminal 3*c* in the 21st position and the signal terminals 3*b* in the 22nd position). One side of the second terminal group 3B is the five successive first terminal groups 3A, and the other side of the second terminal group 3B is the five successive third terminal groups 3C. The ground terminal 3*c* of one first terminal group 3A and the ground terminal 3*c* of one third terminal group 3C are adjacent to the second terminal group 3B. The second terminal group 3B in one row is opposite to a first terminal group 3A or a third terminal group 3C in the other row, and a first terminal group 3A in one row is opposite to a third terminal group 3C in the other row.

To sum up, the electrical connector according to certain embodiments of the present invention has the following beneficial effects:

1. In the three adjacent terminal groups, the second terminal group 3B is located between a first terminal group 3A and a third terminal group 3C, and the first terminal group 3A is arranged in front of the second terminal group 3B, as shown in the 31st position to the 36th position in this embodiment. The first terminal group 3A occupies the 31st and 32nd positions, and the conducting portions 33 of the terminals 3 thereof bend rightward. The second terminal group 3B occupies the 33rd and 34th positions, and the conducting portions 33 of the terminals 3 thereof bend leftward. The third terminal group 3C occupies the 35th and 36th positions, and the conducting portions 33 of the terminals 3 thereof bend rightward. In the arrangement, the bending direction of the conducting portions 33 of the terminals 3 in the second terminal group 3B is opposite to the bending direction of the conducting portions 33 of the terminals 3 in the first terminal group 3A and the third terminal group 3C, thereby increasing the distance between the conducting portions 33 of the two signal terminals 3*b* of the second terminal group 3B and the ground terminals 3*c* located on the two sides thereof, reducing the interference of the ground terminals 3*c* on the signal terminals 3*b*, reducing the signal crosstalk, and ensuring the high-frequency performance of the electrical connector 10.

2. The widened portion 331 on the conducting portion 33 increases the contact area between each terminal 3 and the electrical component, and improves the stable contact between each terminal 3 and the electrical component. The widened portion 331 of the terminal 3 arranged at the front in the same terminal group protrudes forward, and the widened portion 331 of the terminal 3 arranged at the rear protrudes backward, thereby increasing the distance between the two conducting portions 33 in the same terminal group, and avoiding from short-circuiting caused by the contact between the two terminals 3 in the terminal group.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to mate with a mating component and an electrical component, the electrical connector comprising:

a body;

one row of terminals provided in the body, comprising a plurality of signal terminals and a plurality of ground terminals, wherein the terminals are paired to form a plurality of terminal groups, the terminal groups comprise at least one first terminal group, at least one second terminal group and at least one third terminal group, each of the at least one first terminal group is formed by one signal terminal of the plurality of signal terminals and one ground terminal of the plurality of ground terminals, each of the at least one second terminal group is formed by two signal terminals of the plurality of signal terminals, each of the at least one first terminal group is formed by one ground terminal of the plurality of ground terminals and one signal terminal of the plurality of signal terminals, and an arrangement order of the two terminals in each of the at least one third terminal group is different from an arrangement order of the two terminals in each of the at least one first terminal group, wherein each of the terminals has a base provided in the body, a contact portion extending from one end of the base configured to be electrically connected to the mating component, and a conducting portion bending and extending from another end of the base to be electrically connected to the electrical component;

wherein the conducting portions of the terminals in a same terminal group bend in a same direction, and the conducting portions of the terminals in two adjacent ones of the terminal groups bend in opposite directions; and wherein the terminal groups comprise three adjacent terminal groups, the three adjacent terminal groups comprise a corresponding first terminal group, a corresponding second terminal group and a corresponding third terminal group, and in the three adjacent terminal groups, the corresponding second terminal group is located between the corresponding first terminal group and the corresponding third terminal group, and the ground terminal in the corresponding first terminal group and the ground terminal in the corresponding third terminal group are both adjacent to the corresponding second terminal group.

2. The electrical connector according to claim 1, wherein the terminal groups comprise a plurality of successive first terminal groups and a plurality of successive third terminal groups adjacent to each other.

3. The electrical connector according to claim 1, wherein the two signal terminals in the second terminal group form a differential signal pair.

4. The electrical connector according to claim 1, wherein one side of the second terminal group is adjacent to a plurality of first terminal groups successively arranged.

5. The electrical connector according to claim 4, wherein the other side of the second terminal group is adjacent to a plurality of third terminal groups successively arranged.

6. The electrical connector according to claim 1, wherein the conducting portion is soldered to the electrical component by surface-mount technology.

7. The electrical connector according to claim 1, comprising two rows of terminals provided in the body, each of the two rows of terminals comprising a plurality of signal terminals and a plurality of ground terminals, wherein the terminals in each of the two rows are paired to form a plurality of terminal groups, the terminal groups in each of the two rows comprise at least one first terminal group, at least one second terminal group and at least one third terminal group, each of the at least one first terminal group is formed by one signal terminal of the plurality of signal terminals and one ground terminal of the plurality of ground terminals, each of the at least one second terminal group is formed by two signal terminals of the plurality of signal terminals, each of the at least one third terminal group is formed by one ground terminal of the plurality of ground terminals and one signal terminal of the plurality of signal terminals, and an arrangement order of the two terminals in the third terminal group is different from an arrangement order of the two terminals in the first terminal group, wherein each of the terminals in each of the two rows has a base provided in the body, a contact portion extending from one end of the base configured to be electrically connected to the mating component, and a conducting portion bending and extending from another end of the base to be electrically connected to the electrical component; wherein the conducting portions of the terminals in a same terminal group in each of the two rows bend in a same direction, and the conducting portions of the terminals in two adjacent ones of the terminal groups in each of the two rows bend in opposite directions; the two rows of the terminals form a first row, a second row, a third row and a fourth row of the conducting portions in sequence, the first row and the fourth row of the conducting portions bend and extend away from each other, and the second row and the third row of the conducting portions bend and extend toward each other.

8. The electrical connector according to claim 7, wherein the conducting portion of at least one of the second terminal groups is located in the first row or the fourth row.

9. The electrical connector according to claim 7, wherein one of the second terminal groups in one of the two rows of the terminals is provided opposite to one of the first terminal groups or one of the third terminal groups in the other of the two rows of the terminals.

10. The electrical connector according to claim 7, wherein the conducting portions of the terminals in two terminal groups provided opposite to each other in the two rows of the terminals bend in a same direction.

11. The electrical connector according to claim 7, wherein the body comprises a slot extending longitudinally to be inserted by the mating component, the contact portion is exposed in the slot to contact the mating component, and the two rows of terminals are provided at two opposite sides of the slot.

12. The electrical connector according to claim 7, wherein each of the two rows of the terminals further comprises a plurality of power terminals and a plurality of reserved terminals, the reserved terminals are configured to be used as power, signal or ground terminals, and the two rows of the terminals collectively occupy 288 terminal positions, wherein in one of the two rows of terminals, a first position, a second position and a third position are occupied by the power terminals, a fourth position, a fifth position, a seventh position, a ninth position, an eleventh position, a twelfth position, a fourteenth position, a sixteenth position, an eighteenth position, a 20th position, a 22nd position, a 23rd position, a 25th position, a 27th position, a 29th position, a 31st position, a 33rd position, a 34th position, a 36th position, a 38th position, a 40th position, a 42nd position, a 44th position, a 45th position, a 47th position, a 49th position, a 51st position, a 53rd position, a 55th position, a 56th position, a 58th position, a 60th position, a 62nd position, a 64th position, a 66th position, a 68th position, a 70th position, a 72nd position, a 74th position, a 76th position, a 78th position, an 80th position, an 82nd position, an 84th position, an 86th position, an 87th position, an 89th position, a 91st position, a 93rd position, a 94th position, a 96th position, a 98th position, an 100th position, an 102nd position, an 104th position, an 105th position, an 107th position, an 109th position, an 111th position, an 113th position, an 115th position, an 116th position, an 118th position, an 120th position, an 122nd position, an 124th position, an 126th position, an 127th position, an 129th position, an 131st position, an 133rd position, an 135th position, an 137th position, an 138th position, an 140th position and an 142nd position are occupied by the signal terminals, a sixth position, an eighth position, a tenth position, a thirteenth position, a fifteenth position, a seventeenth position, a nineteenth position, a 21st position, a 24th position, a 26th position, a 28th position, a 30th position, a 32nd position, a 35th position, a 37th position, a 39th position, a 41st position, a 43rd position, a 46th position, a 48th position, a 50th position, a 52nd position, a 54th position, a 57th position, a 59th position, a 61st position, a 63rd position, a 65th position, a 67th position, a 69th position, a 71st position, a 73rd position, a 75th position, a 77th position, a 79th position, an 81st position, an 83rd position, an 85th position, an 88th position, a 90th position, a 92nd position, a 95th position, a 97th position, a 99th position, an 101st position, an 103rd position, an 106th position, an 108th position, an 110th position, an 112th position, an 114th position, an 117th position, an 119th position, an 121st position, an 123rd position, an 125th position, an 128th position, an 130th position, an 132nd position, an 134th position, an 136th position, an 139th position, an 141st position and an 143rd position are occupied by the ground terminals, and a 144th position is occupied by one of the reserved terminals; and wherein in the other of the two rows of terminals, an 145th position and an 146th position are occupied by the power terminals, an 147th position, an 148th position, an 149th position, an 150th position, a 220th position, a 231st position and a 232nd position are the reserved terminals, an 151st position, an 153rd position, an 155th position, an 158th position, an 160th position, an 162nd position, an 164th position, an 166th position, an 169th position, an 171st position, an 173rd position, an 175th position, an 177th position, an 180th position, an 182nd position, an 184th position, an 186th position, an 188th position, an 191st position, an 193rd position, an 195th position, an 197th position, an 199th position, a 202nd position, a 204th position, a 206th position, a 208th position, a 210th position, a 212th position, a 214th position, a 216th position, a 219th position, a 222nd position, a 224th position, a 226th position, a 228th position, a 230th position, a 233rd position, a 235th position, a 237th position, a 240th position, a 242nd position, a 244th position, a 246th position, a 248th position, a 251st position, a 253rd position, a 255th position, a 257th position, a 259th position, a 262nd position, a 264th position, a 266th position, a 268th position, a 270th position, a 273rd position, a 275th position, a 277th position, a 279th position, a 281st position, a 284th position, a 286th position and a 288th position are occupied by the ground terminals, and an 152nd position, an 154th position, an 156th position, an 157th position, an 159th position, an 161st position, an 163rd position, an 165th position, an 167th position, an 168th position, an 170th position, an 172nd position, an 174th position, an 176th position, an 178th position, an 179th position, an 181st position, an 183rd position, an 185th position, an 187th position, an 189th position, an 190th position, an 192nd position, an 194th position, an 196th position, an 198th position, a 200th position, a 201st position, a 203rd position, 205th position, a 207th position, a 209th position, a 211th position, a 213th position, a 215th position, a 217th position, a 218th position, a 221st position, a 223rd position, a 225th position, a 227th position, a 229th position, 234th position, a 236th position, a 238th position, a 239th position, a 241st position, a 243rd position, a 245th position, a 247th position, a 249th position, a 250th position, a 252nd position, a 254th position, a 256th position, 258th position, a 260th position, a 261st position, a 263rd position, a 265th position, a 267th position, a 269th position, a 271st position, a 272nd position, a 274th position, a 276th position, a 278th position, a 280th position, 282nd position, a 283rd position, a 285th position and a 287th position are occupied by the signal terminals.

13. The electrical connector according to claim 7, wherein the conducting portions of the terminals in each of the two rows are respectively provided with the conducting portions of the terminals in the first terminal groups, the conducting portions of the terminals in the second terminal groups and the conducting portions of the terminals in the third terminal groups.

14. The electrical connector according to claim 7, wherein the four rows of the conducting portions are all soldered to the electrical component by surface-mount technology.

15. The electrical connector according to claim 1, wherein the body comprises a slot extending longitudinally for inserting the mating component, the body is provided with a key buckle in the slot to engage with a notch on the mating component, the key buckle divides the slot into two portions having different lengths, and the key buckle is located between the two terminals of one of the terminal groups.

16. The electrical connector according to claim 15, wherein the key buckle is located between the two terminals of one of the first terminal groups or between the two terminals of one of the third terminal groups.

* * * * *